US007575452B2

(12) United States Patent
Chikashige et al.

(10) Patent No.: US 7,575,452 B2
(45) Date of Patent: Aug. 18, 2009

(54) SLIDER UNIT AND CARD CONNECTOR

(75) Inventors: Kiyoshi Chikashige, Tokyo (JP); Ryusuke Tokui, Tokyo (JP)

(73) Assignee: Advanex, Inc., Tokyo (JP)

( * ) Notice: Subject to any disclaimer, the term of this patent is extended or adjusted under 35 U.S.C. 154(b) by 98 days.

(21) Appl. No.: 11/912,628

(22) PCT Filed: Apr. 24, 2006

(86) PCT No.: PCT/JP2006/308517

§ 371 (c)(1),
(2), (4) Date: Oct. 25, 2007

(87) PCT Pub. No.: WO2006/118068

PCT Pub. Date: Nov. 9, 2006

(65) Prior Publication Data

US 2009/0075507 A1 Mar. 19, 2009

(30) Foreign Application Priority Data

Apr. 26, 2005 (JP) ..... P2005-128117

(51) Int. Cl.
*H01R 13/62* (2006.01)

(52) U.S. Cl. ..... 439/159

(58) Field of Classification Search ..... 439/159, 439/160

See application file for complete search history.

(56) References Cited

U.S. PATENT DOCUMENTS 6,390,836 B1 5/2002 Motegi et al.
6,554,627 B1 * 4/2003 Chen ..... 439/159
6,592,385 B1 * 7/2003 Chen ..... 439/159
6,609,919 B2 8/2003 Ito et al.
6,773,280 B2 8/2004 Sasaki et al.
6,840,786 B2 * 1/2005 Sato et al. ..... 439/159
6,875,034 B1 * 4/2005 Su et al. ..... 439/159
6,896,555 B1 * 5/2005 Su et al. ..... 439/630

(Continued)

FOREIGN PATENT DOCUMENTS

CN 2657218 11/2004

(Continued)

OTHER PUBLICATIONS

Chinese Office Action dated Apr. 3, 2009, for corresponding Chinese Patent Application No. 200680013828.4.

*Primary Examiner*—Ross N Gushi
(74) *Attorney, Agent, or Firm*—K&L Gates LLP

(57) ABSTRACT

A slider unit and a card connector having a slider that is arranged in a housing so as to be capable of moving along the insertion/ejection directions of a card and whose position is capable of being switched by a heart cam mechanism between a first position and a second position that is farther from an opening than the first position. A coil spring that biases the slider in the card ejection direction; an abutting portion that is integrally formed in the slider and is capable of abutting the insertion direction side of the card; and a pipe that is provided in the slider and retains the coil spring by being inserted in the coil spring, where both ends of the shaft that protrude from the coil spring becoming enlarged diameter portions and that are partially widened compared to the middle portion on which the coil spring is fitted.

4 Claims, 7 Drawing Sheets

U.S. PATENT DOCUMENTS

| | | | | |
|---|---|---|---|---|
| 6,951,471 | B1 * | 10/2005 | Chen | 439/159 |
| 7,008,245 | B1 * | 3/2006 | Chien | 439/159 |
| 7,033,190 | B1 * | 4/2006 | Chen | 439/159 |
| 7,044,757 | B1 * | 5/2006 | Yen | 439/138 |
| 7,077,671 | B2 * | 7/2006 | Su et al. | 439/159 |
| 2002/0155739 | A1 * | 10/2002 | Sato et al. | 439/159 |
| 2003/0119350 | A1 * | 6/2003 | Chen | 439/159 |
| 2005/0272290 | A1 * | 12/2005 | Yoneyama et al. | 439/159 |
| 2006/0089033 | A1 * | 4/2006 | Chen | 439/159 |
| 2008/0050937 | A1 * | 2/2008 | Miyao et al. | 439/64 |
| 2008/0057760 | A1 * | 3/2008 | Tian et al. | 439/159 |
| 2009/0035971 | A1 * | 2/2009 | Tsuji | 439/159 |

FOREIGN PATENT DOCUMENTS

| | | |
|---|---|---|
| JP | 2001-143815 | 5/2001 |
| JP | 3431608 | 5/2003 |
| JP | 2003-217738 | 7/2003 |
| JP | 2004-119182 | 4/2004 |
| JP | 2004-241180 | 8/2004 |
| JP | 2004/259614 | 9/2004 |
| JP | 2005-276676 | 10/2005 |

* cited by examiner

*FIG. 2*
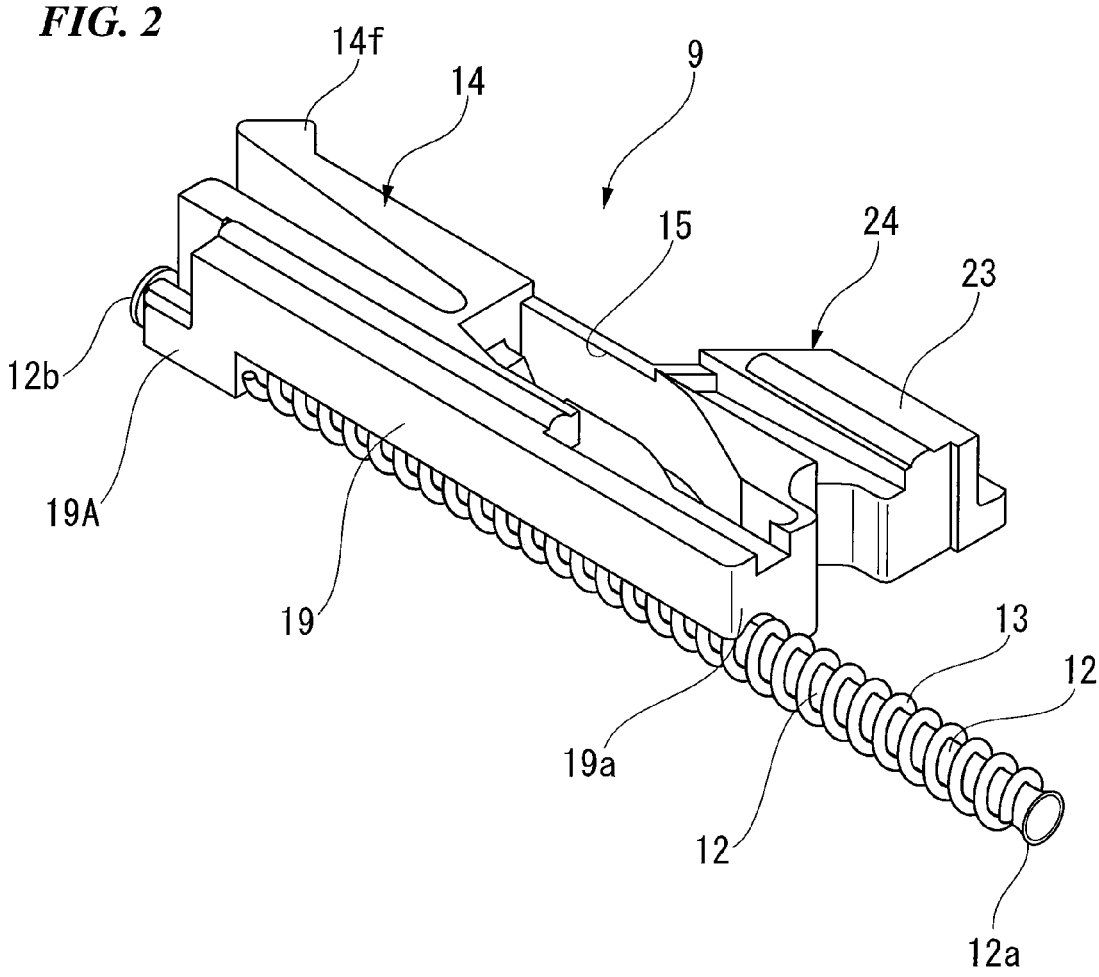
*FIG. 3A* *FIG. 3B*
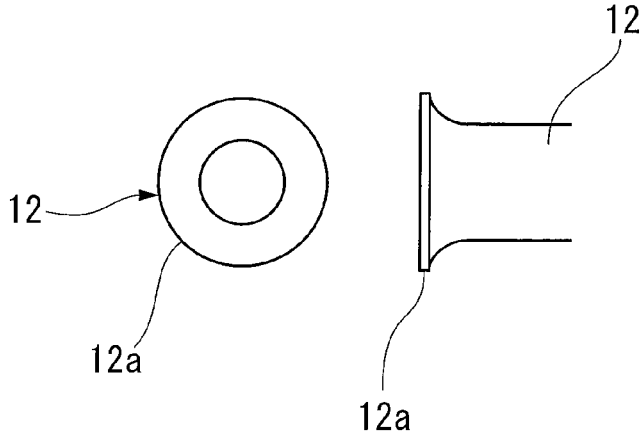

SLIDER UNIT AND CARD CONNECTOR

CROSS REFERENCE TO RELATED APPLICATIONS

The present application claims priority to Japanese Patent Application No. 2005-128117, filed in the Japanese Patent Office on Apr. 26, 2005, the content of which is incorporated herein by reference.

BACKGROUND

In recent years, compact memory cards have come to be widely used in various terminal devices such as mobile phones and digital cameras and the like for recording or transmitting audio data and image data shot with digital cameras. In a connector of a device that uses such cards, an eject mechanism is provided that should be able to eject a card that is inserted and connected with a simple operation.

As an eject mechanism, a push-push-type card eject mechanism (that ejects a card by activation of an eject mechanism by re-pressing an inserted card) has been developed with a heart cam mechanism (for example, see Patent Document 1 and Patent Document 2).

In this kind of eject mechanism, normally a slider is provided that guides the card in the insertion/ejection direction, with this slider being biased in the direction of ejecting the card by a coil spring. Here, when the coil spring is not held in a state of being guided in the length direction, it easily buckles. Therefore, the coil spring is normally inserted in a cylindrical portion that is formed in the slider and held therein (for example, refer to FIG. 3 and FIG. 15 of Patent Document 1).

Patent Document 1: Japanese Patent No. 3431608

Patent Document 2: Japanese Unexamined Patent Application, First Publication No.: 2003-21773

On the other hand, particularly in devices where miniaturization is sought such as mobile phones, there is a demand for miniaturization of such a card connector that is mounted therein. Accordingly, miniaturization is also strongly required fort the eject mechanism. However, when the eject mechanism as described above is one that is constituted by holding the coil spring in a cylindrical portion, the eject mechanism require extra space in the width direction and thickness direction by the wall thickness of the cylindrical portion. Accordingly, this has hindered the miniaturization Of the card connector.

Also, when the slider that has this cylindrical portion is molded witty a die, a slider core is required for the cylindrical portion. Accordingly, the die becomes complicated, leading to an increase in the initial cost. Moreover, due to the complication of the die, multi-cavity molding becomes difficult, leading to an increase in the running cost.

For that reason, for example, by fitting the coil spring around a narrow shaft to hold the coil spring, buckling of the coil spring is prevented and it can be favorably held, so that the conventional cylindrical portion becomes unnecessary. Moreover, since the shaft that is provided in place of the cylindrical portion is inserted in the coil spring, the space especially for the shaft is not required. Thereby, that portion of space that was required for the cylindrical portion can be eliminated, enabling the miniaturization of the eject mechanism. However, when passing a coil spring through a shaft, problems arise such as handling being difficult due to the coil spring separating from the shift and time and effort needed for assembly.

SUMMARY

The present invention relates to a slider unit that stores and ejects cards such as memory cards or the like and a card connector that is provided with this slider unit. The present embodiments provide a slider unit and a card connector that is readily assembled and enables miniaturization of the card connector and a reduction in costs.

In one embodiment, a slider unit is provided in a housing, in which a card housing space that allows the insertion of a card from an opening is formed, and performs housing of the card into the card housing space and ejection of the card from the card housing space includes: a slider that is arranged in the housing so as to be capable of moving along the insertion/ejection directions of the card and whose position is capable of being switched by a heart cam mechanism between a first position and a second position that is farther from the opening than the first position; a coil spring that biases the slider in the card ejection direction; an abutting portion that is integrally formed in the slider and is capable of abutting the insertion direction side of the card; and a shaft that is provided in the slider and retains the coil spring by being inserted in the coil spring; in which both ends of the shaft that protrude from the coil spring become enlarged diameter portions that are partially widened compared to the middle portion on which the coil spring is fitted.

In an embodiment, one end of the shaft is held by the slider.

In an embodiment, a card connector includes: a housing that forms a card housing space that allows the insertion of a card from an opening and is provided with an input/output terminal that corresponds to an electrode portion of the card; a slider that is capable of moving along the insertion/ejection directions of the card and whose position is capable of being switched by a heart cam mechanism between a first position and a second position that is farther from the opening than the first position; a coil spring that biases the slider in the card ejection direction; and an abutting portion that is integrally formed in the slider and is capable of abutting the insertion direction side of the card; in which the coil spring is fitted on a middle portion of a shaft that has enlarged diameter portions at both ends that are partially widened compared to the middle portion.

In an embodiment, one end of the shaft is held by the slider.

In an embodiment, since a coil spring is retained by inserting a shaft in the coil spring, the coil spring can be favorably retained by preventing buckling of the coil spring. In addition a conventional cylindrical portion is not required, and since the shaft that is provided instead of the cylindrical portion is inserted in the coil spring, a space especially for the shaft is not required. Accordingly, it is possible to eliminate the portion of space that was required for the conventional cylindrical portion. Therefore, miniaturization of a device that uses this slider unit becomes possible. Also, a die that forms this becomes comparatively simplified due to the absence of the cylindrical portion. Accordingly, since it is easy to configure this die for multi-cavity molding, it is possible to achieve a reduction of costs in terms of both the initial cost and running cost. Moreover, since enlarged diameter portions are formed at both end portions of the shaft, a coil spring that is once fitted and held between the large diameter portions does not fall out, and therefore is easy to handle. Also, when incorporated into the housing, since the coil spring does not come into direct contact with a side wall of the housing, it is possible to prevent slight distortions of the housing due to the biasing force of the coil spring being applied to the housing. Also, since the connector is generally mounted on the substrate by reflow soldering, even though the housing, as a result of being elevated to a high temperature during soldering, is in a state of readily deformed, since the coil spring does not directly abut the housing, it is possible to prevent distortion of the housing due to the biasing force of the coil spring.

In an embodiment, one end of the shaft is held by the slider, so the coil spring is integrated with the shaft and the slider, whereby assemblability is improved during assembly and an improvement in productivity is achieved.

In an embodiment, similarly to the slider unit, since a coil spring is retained by inserting a shaft in the coil spring, it is possible to eliminate the portion of space that was required for the conventional cylindrical portion, which enables miniaturization thereof. Also, a die that forms this becomes comparatively simplified due to the absence of the cylindrical portion. Accordingly, since it is easy to configure this die for multi-cavity molding, it is possible to achieve a reduction of costs in terms of both the initial cost and running cost. Moreover, since enlarged diameter portions are formed at both end portions of the shaft, a coil spring that is once fitted and held between the large diameter portions does not fall out, and therefore is easy to handle. Also, it is preferable that both ends of the shaft are retained in a retaining portion that is formed in the housing. With such a constitution, since the coil spring does not come into direct contact with a retaining portion of the housing, it is possible to prevent distortions of the housing that arise due to the biasing force of the coil spring being applied to the retaining portion, and in addition, the assembly of the shaft portion to the housing improves by simply retaining both ends of the shaft on which the coil spring is fitted in advance in the retaining portion, and so the workability is extremely good.

In an embodiment, one end of the shaft that passes through and retains the coil spring in advance is retained in the slider and integrated with the slider. Therefore, it becomes easy to handle, and accordingly mounting to the housing is easy, so that workability is extremely favorable.

Additional features and advantages are described herein, and will be apparent from, the following Detailed Description and the figures.

BRIEF DESCRIPTION OF THE FIGURES

FIG. 2 A perspective view of the slider.

FIG. 3 A is a plan view showing the shape of the enlarged diameter portion of the pipe, while B is a side view thereof.

DETAILED DESCRIPTION

Figure 1:
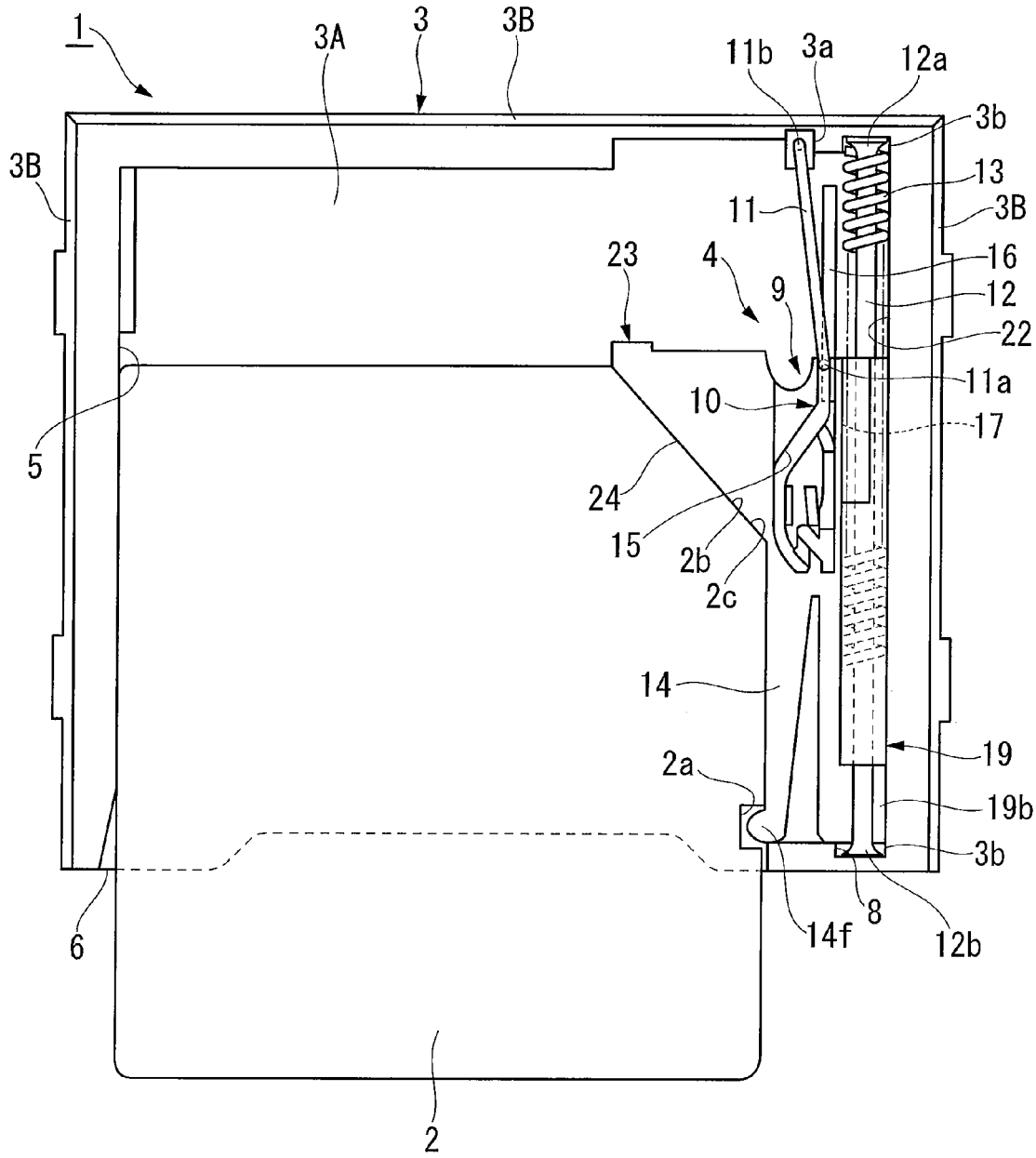
FIG. 1 A plan view that shows one embodiment of the card connector.

FIG. 1 is a plan view showing an embodiment of a card connector, with reference numeral 1 in FIG. 1 denoting a card connector, and reference numeral 2 denoting a card that is inserted into and ejected from the card connector 1. Note that in FIG. 1, for the explanation of the inner portion, a cover of a housing 3 (not illustrated) is shown in a transparent state.

The card connector 1 in the present embodiment is the one that would be mounted in a mobile phone, and is constituted to be provided with a housing 3 that houses the card 2 and a slider unit 4 that is incorporated in the interior of the housing 3. Note that the card 2 is a plate-shaped storage medium such as a memory card or the like, and performs recording of audio data or image data or the like. A plurality of electrodes that serve as terminals (not illustrated) are formed on the distal end side of the card 2, that is, the side to be housed in the housing 3. Input/output terminals (not illustrated) that are formed by folding back narrow, belt-shaped flat springs with electrical conductivity are provided in the housing 3 at positions corresponding to the electrodes of the card 2, that is, at positions that respectively come into contact and electrically connect with the electrodes when the card 2 is inserted until a second position described below.

Note that the electrodes of the card 2 may be a normal type that are inserted in the housing 3 facing the lower side, or conversely may be a reverse type that are inserted in the housing 3 facing the upper side. In this case, the position of the input/output terminals on the side of the housing 3 must of course be determined in advance in accordance with the type of card 2 that is to be used.

Also, an engagement recess portion 2*a* that detachably engages with an engagement portion 14*f* of a lock portion 14 described below is formed on one side of the card 2, and a notch portion 2*b* is formed further to the distal end side (in the insertion direction side) than the engagement recess portion 2*a*. The notch portion 2*b* is formed by a portion of the corner of the card 2 being cut away, and so particularly the area of the leading side beyond the engagement recess portion 2*a* becomes an oblique side 2*c* that is slanted with respect to the side of the card 2.

The housing 3 has a housing body made of a synthetic resin that has a rectangular bottom plate 3A and side plates 3B that rise up on three sides from the bottom plate 3A (FIG. 1 shows only the housing body as the housing 3) and a metal cover (not illustrated) that covers the top portion thereof. The interior of the housing 3 serves as a card housing space 5 and the housing 3 has an opening 6 to the card housing space 5 on the side where the side plate 3B is not formed. Here, the opening 6 is formed slightly offset to one side in the width direction of the housing 3 (in the direction that is perpendicular to the insertion direction of the card 2), with a slider unit housing portion 8 for housing the slider unit 4 on the other side of the housing 3.

Figure 5A:
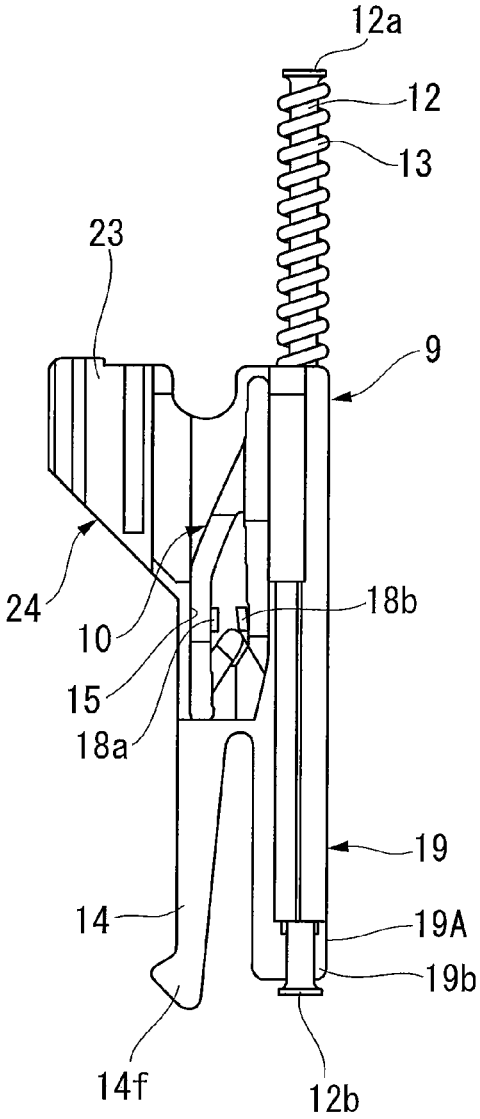
FIG. 5 A is a plan view that shows the constitution of the slider; B is a bottom view thereof; and C is a side view thereof.
Figure 5B:
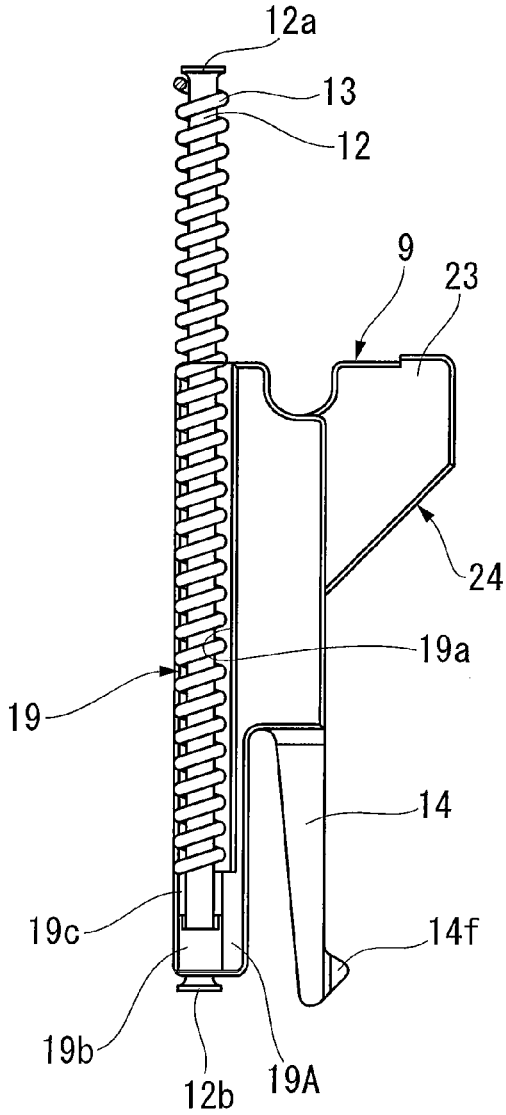
Figure 5C:
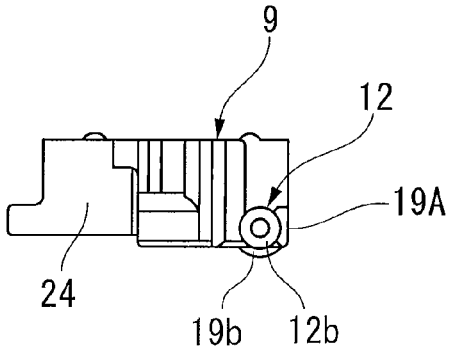

The slider unit 4 that is housed in the slider unit housing portion 8 has a configuration shown in FIG. 5A and FIG. 5B and constitutes an eject mechanism, having a slider 9 made of resin that is provided to be movable along the insertion/ejection direction of the card 2, a cam follower 11 that constitutes a heart cam mechanism 10 of the slider 9, a cylindrical pipe (shaft) 12 that is provided in the slider 9, and a coil spring 13 that is fitted around the pipe 12. Note that a cylindrical narrow bar may be used instead of the pipe 12.

Figure 6:
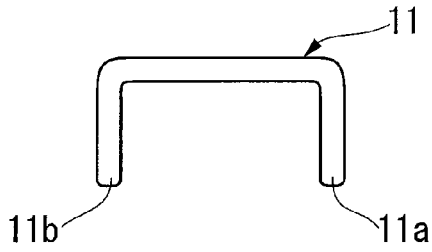
FIG. 6 A side view of the cam follower.

On the top surface side of the slider 9, as shown in FIG. 1 and FIG. 5A, there is formed a cam groove 15 that constitutes the heart cam mechanism 10. The cam groove 15 is one conventionally publicly known having an approximate heart shape when viewed from above, and one end portion 11*a* of the cam follower 11 shown in FIG. 6 runs relatively in this cam groove 15, thereby positioning the card 2 in the card housing space 5. The cam follower 11, as shown in FIG. 6, consists of a metal, U-shaped thin bar that is formed by bending both end sides approximately at right angles. As mentioned above, the one end portion 11*a* is a free end that is able to run in the cam groove 15, while the other end portion 11*b* is attached and retained in a rotatable manner to a mounting hole 3*a* (refer to FIG. 1) that is formed in the housing 3. Also, the center portion of the cam follower 11 is always biased by the cover of the housing 3 (not illustrated), and thereby both end portions, that is, the one end portion 11*a* and the other end portion 11*b*, are biased to the housing 3 side. Thereby, particularly the one end portion 11*a* runs in the cam groove 15 without separating from the cam groove 15.

Figure 7:
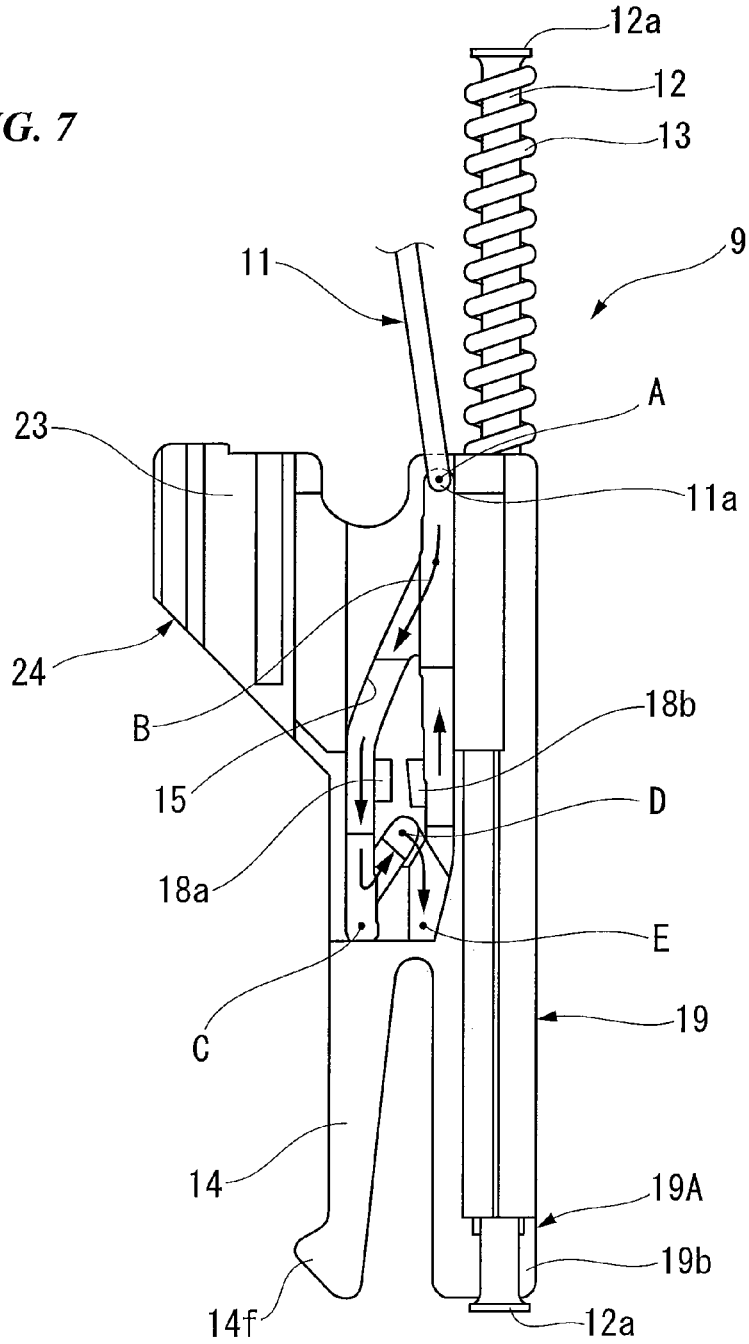
FIG. 7 A plan view for explaining the constitution of the cam groove.

In the cam groove 15, as shown in FIG. 1 and FIG. 7, in order the one end portion 11*a* of the cam follower 11 to proceed in one direction shown by the arrows, steps and slopes are provided at predetermined places. That is, in the initial state when the card 2 has not been pushed in as described below, and the slider 9 has not been moved to the back side of the card housing space 5 by the card 2, the one end portion 11*a* of the cam follower 11 is positioned at a point A of the cam groove 15 as shown in FIG. 7. Note that the position of the slider 9 in this initial state is referred to as a "first position."

Then, when the slider 9 extends by insertion of the card 2 as described below, the cam groove 15 allows the one end portion 11*a* of the cam follower 11 to pass through point B and C along the arrows until reaching point D. At point B, the cam groove 15 branches into two directions. However, since a step is formed in one of the branches, it is made to travel toward point C along the arrows.

Upon reaching point C, the one end portion 11*a* of the cam follower 11 cannot proceed further. When at the time of this state pressing on the card 2 is released, the slider 9 retracts by the biasing force of the coil spring 13, and the one end portion 11*a* moves through the cam groove 15 of the slider 9 to the point D. After passing through point C to reach point D, the movement of the slider 9 is stopped and is held in this state. Note that the position of the slider 9 at the time when the one end portion 11*a* of the cam follower 11 is stopped at this point D is referred to as a "second position."

Then, when the slider 9 is once again made to extend from this state, the one end portion 11*a* of the cam follower 11 is moved through the cam groove 15 to point E along the arrows. Upon reaching point E, the one end portion 11*a* of the cam follower 11 cannot proceed any further, and when the pressing on the card 2 is released in this state, the one end portion 11*a* travels to the point B and moreover returns to the point A. At the point D, since a step is formed in the direction of returning to the point C, it is always made to travel to the point E.

Also, as shown in FIG. 7, in the vicinity of the cam groove 15 of the slider 9 a first projected wall 18*a* is formed between the point B and the point C, and a second projected wall 18*b* is formed in the vicinity of the point D so as to project upward from the opening side of the cam groove 15. The first projected wall 18*a* makes contact with the middle portion of the cam follower 11 when the one end portion 11*a* of the cam follower 11 moves relatively in the cam groove 15 as described above and, by moving from point B to point C, the slider 9 moves from the first position to the second position, thereby causing the one end portion 11*a* of the cam follower 11 to surmount the first projected wall 18*a*. Also, the second projected wall 18*b* abuts the middle portion of the cam follower 11 when the slider 9 returns to the first position from the second position as a result of the one end portion 11*a* moving to return from point D to point A via point E, and thereby causes the one end portion 11*a* of the cam follower 11 to surmount the second projected wall 18*b*. Then, by making the cam follower 11 surmount in this way, the first projected wall 18*a* and the second projected wall 18*b* provide a click sensation to the person performing the insertion/ejection of the card 2. Note that the top surfaces of the first projected wall 18*a* and the second projected wall 18*b* are slanted, and so when the cam follower 11 surmounts them, it is able to smoothly do so without getting stuck.

Also, a pipe retaining portion 19 is formed on the opening 6 side of the housing 3, on the side opposite the card housing space 5 as shown in FIG. 1. This pipe retaining portion 19, as shown in FIG. 2 and FIG. 5B, has a groove 19*a* that accommodates the pipe 12 described below. On one end thereof, an end portion retaining portion 19A is formed which holds one end side of the pipe 12. This end portion retaining portion 19A has retaining portions 19*b* and 19*c* that bend in mutually opposing directions as shown in FIG. 5B, and they are arranged at positions shifted in the axial direction of the pipe 12, thereby trapping one end side of the pipe 12 and sandwiching it in a manner that allows it to slide. That is, the pipe 12 is constituted so as to be inserted between the retaining portion 19*b* and the retaining portion 19*c*.

Figure 4A:
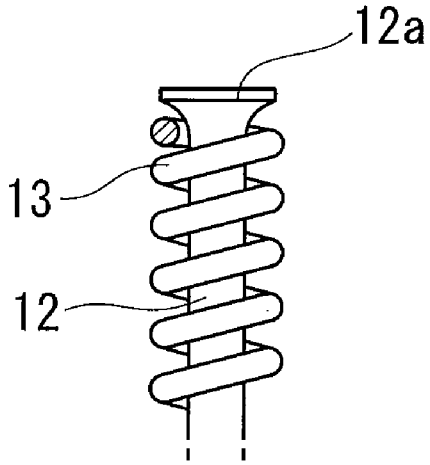
FIG. 4 A is a main portion enlarged view that shows the enlarged diameter portion that is formed at the ends of the pipe, while B is a main portion enlarged plan view that shows the state of the pipe mounted in the housing.

The pipe 12, as shown in FIG. 2 and FIG. 3A, is made of metal and formed in a cylindrical shape, and as described above is inserted in the coil spring 13 so that the coil spring 13 is fitted outside. The pipe 12 is formed to be longer than the length of the coil spring 13, that is, longer than when the coil spring 13 is not compressed and is extended in a no-load state. Thereby, retain the coil spring 13 in the state of both ends of the pipe 12 projecting from the coil spring 13. As shown in FIG. 1 and FIG. 3B, the diameters of both ends of the pipe 12 form enlarged diameter portions 12*a* and 12*b*, respectively, in which the wire diameter is partially enlarged compared to the other portion, that is, the middle portion, and are formed by a sizing process that involves making the wall thickness flow by high pressure. Both enlarged diameter portions 12*a* and 12*b* are, as shown in FIG. 1 and FIG. 4A, at their maximum diameters wider than the spring diameter of the coil spring 13. For that reason, when the coil spring 13 is fitted over the middle portion of the pipe 12, it is held without separating from the pipe 12. In the case of retaining the coil spring 13 on the pipe 12, by forming the enlarged diameter portion 12*a* on only one side in advance, the coil spring 13 is fitted from the other end side. By doing so, after installing the other end side of the pipe 12, from which the coil spring 13 has been thus fitted, on the pipe retaining portion 19 of the slider 9, the enlarged diameter portion 12*b* is formed on the other end side of the pipe 12 that projects outside from the end portion retaining portion 19A. At this time, the coil spring 13 that has been fitted on the pipe 12 is in a state of contact with the one side of the end portion retaining portion 19A, as shown in FIG. 2.

Figure 4B:
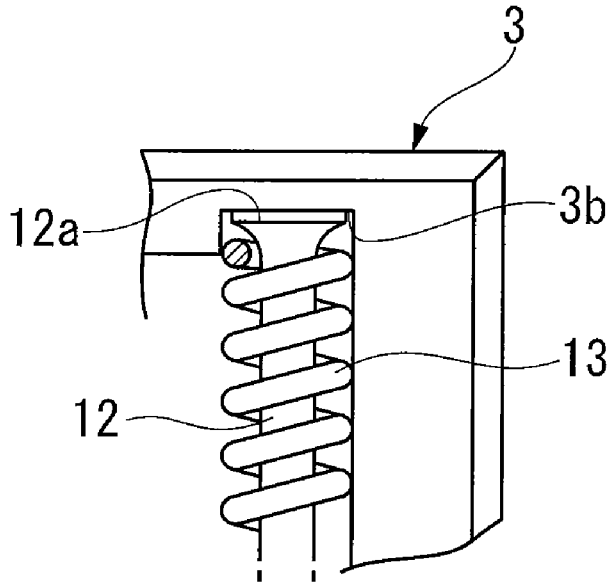

In this way, by enlarging the diameter of the pipe 12, the coil spring 13 does not come into direct contact with a retaining portion 3*b* that is formed on the side wall of the housing 3 as shown in FIG. 4B. Accordingly, it is possible to prevent slight distortions occurring in the housing 3 due to the biasing force of the coil spring 13 being always applied to the housing 3. Note that the card connector 1 is normally mounted on the substrate by reflow soldering and so, even under the elevated temperature during reflow soldering, since the coil spring 13 does not come into direct contact with the housing 3, it is possible to prevent distortion of the housing 3 due to the biasing force of the coil spring 13.

Moreover, by thus forming the enlarged diameter portions 12*a* and 12*b* on both end portions of the pipe 12, the coil spring 13 that is fitted and retained between the enlarged diameter portions 12*a* and 12*b* does not escape from the pipe 12, and since it is integrated with the pipe 12 and the slider 9, assemblability is facilitated during assembly, so that an improvement in productivity is achieved.

The enlarged diameter portions 12*a* and 12*b* of the coil spring 13 are respectively retained by the retaining portion 3*b* that is formed on the side wall of the housing 3, and thereby the pipe 12 is fixed to the housing 3. Accordingly, the pipe 12 has a function as a guide when the slider moves (extends and retracts) as described below. The coil spring 13 that is fitted on the pipe 12 is retained in a manner to be able to expand and contract on the pipe 12, and retains an orientation of being extended in the same direction as the pipe 12 without buckling.

Also, as shown in FIG. 1 and FIG. 2, a lock portion 14 is formed on the back end side of the slider 9 on the side of the card housing space 5. The lock portion 14 is formed so as to extend along the pipe retaining portion 19, and is disposed at an interval with respect to the pipe retaining portion 19 on the side of the card housing space 5. On the distal end portion, as shown in FIG. 1, the engagement portion 14*f* projecting towards the side of the card housing space 5 is formed, that is constituted to detachably engage with the engagement recess portion 2*a* that is formed in the card 2. The engagement portion 14*f* is formed in a substantially triangular shape. Accordingly, when it is pressed by the card 2, this pressing force is converted to a force that heads (escapes) in the horizontal direction, and so the lock portion 14 is biased to the opposite side from the card housing space 5. That is, this lock portion 14 is formed to be able to bend toward the side of the pipe retaining portion 19. As described below, when a force is applied in the horizontal direction (the direction of the inner surface 22), the lock portion 14 bends toward the side of the pipe retaining portion 19 by that force.

Also, an abutting portion 23 that abuts the notch portion 2*b* in the insertion direction side of the card 2 is integrally formed at the distal end side of the slider 9.

Next, the method of inserting and ejecting the card 2 to/from the card connector 1 of this constitution is described.

To insert the card 2 in the card connector 1, first the card 2 is inserted from the opening 6 to the card housing space 5 and then pushed inward. Upon doing so, the oblique side 2*c* of the notch portion 2*b* formed in the card 2 as shown in FIG. 1 abuts the engagement portion 14*f* of the lock portion 14, and by pressing it, the pressing force is converted to a horizontal direction (the direction toward the inner surface 22), and thereby the lock portion 14 is biased to the side of the inner surface 22. Then, because the lock portion 14 is constituted to bend to the side of the pipe retaining portion 19 as described above, the engagement portion 14*f* retracts to the side of the inner surface 22 by the lock portion 14 bending to the side of the pipe retaining portion 19. When the card 2 is pushed in further in this state, the engagement portion 14, as a result of being pressed by the side of the card 2, is held in the retracted state. Then, the notch portion 2*b* in the insertion direction side abuts the abutting portion 23, and at this time, the engagement recess portion 2*a* of the card 2 reaches the position corresponding to the engagement portion 14*f*. Thereby, the pushing pressure onto the lock portion 14 is released, and the engagement portion 14*f* returns to its original position and engages with the engagement recess portion 2*a*. Accordingly, the card 2 is in a state of being locked (half locked) in the card connector 1.

Next, from this state, that is, the state of the slider 9 being in the first position, in order the electrodes (terminals) of the card 2 to be conducted by being connected to the input/output terminals on the side of the housing 3, the card 2 are further pushed and it is further pushed to the back side of the card housing space 5 together with the slider 9. At this time, since the pipe 12 is held by the housing 3 and serves as a guide, the extending of the slider 9 is performed in a straight manner without slipping sideways.

Note that when the slider 9 retracts, it also does so as it does when extending in a straight manner without slipping sideways.

Figure 8C:
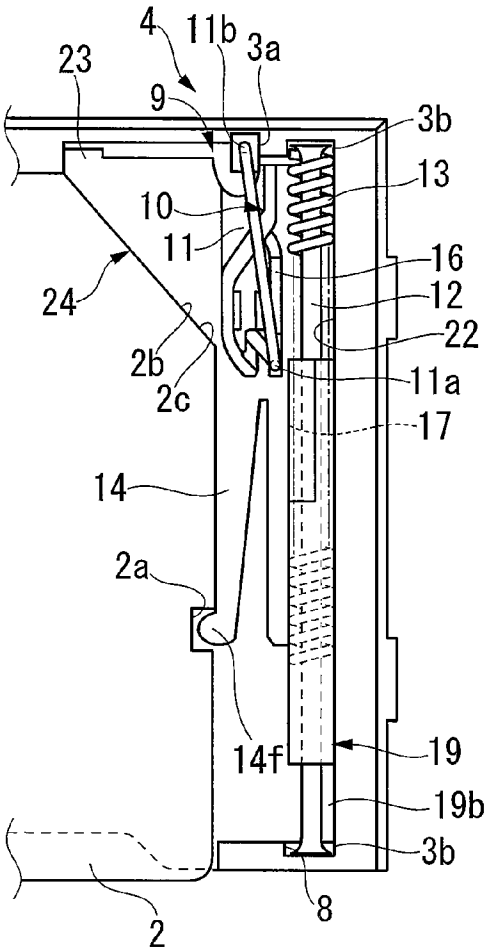
FIG. 8 A is a plan view for explaining the operation of the slider by the insertion/ejection operation of the card; B is another plan view; and C is yet another plan view.
Figure 8B:
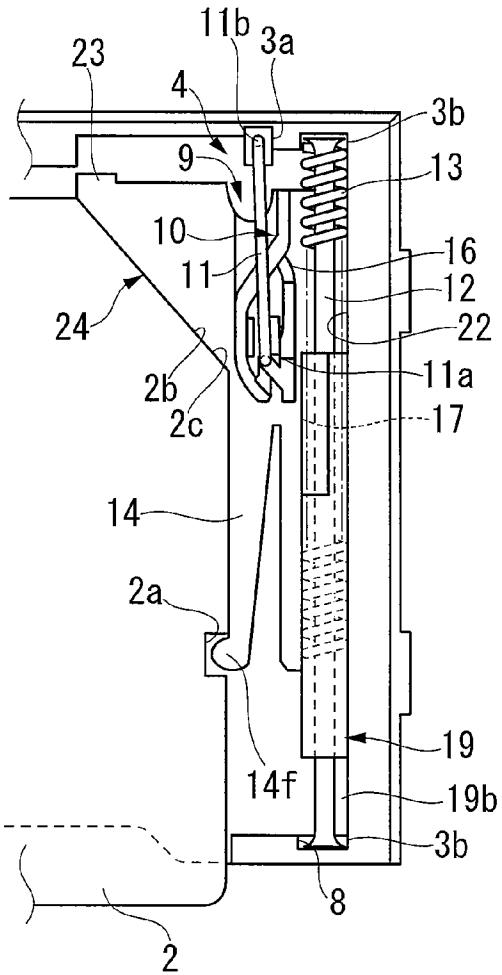
Figure 8A:
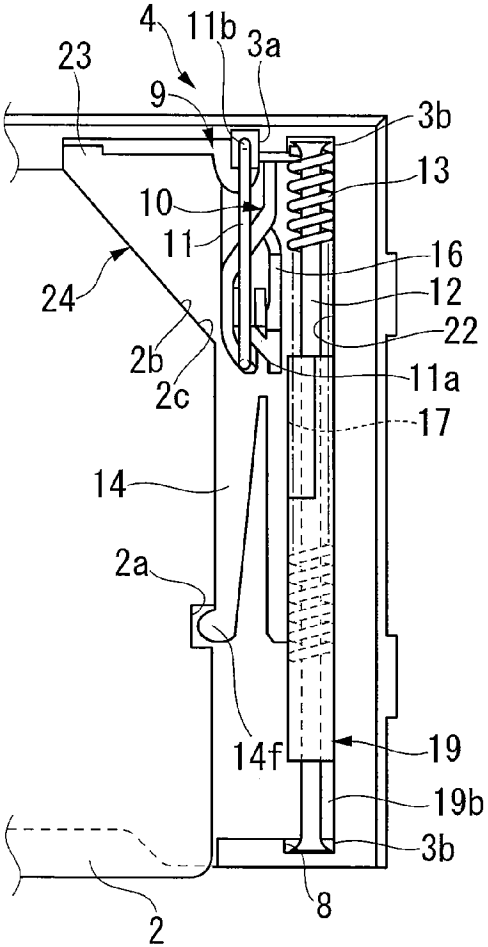

When the card 2 is pushed in with the slider 9 in this way, the card 2 is guided to the second position by the heart cam mechanism 10 as shown in FIG. 8B. That is, in tandem with the movement of the slider 9, the one end portion 11*a* of the cam follower 11 moves relatively in the cam groove 15 of the slider 9, whereby the card 2 is guided to the second position by the slider 9. The movement of the one end portion 11*a* of the cam follower 11 passes from point A in the cam groove 15 through points B and C along the arrows as shown in FIG. 7 and reaches point D. Note that by pushing the card 2 to extend the slider 9, the coil spring 13 that is fitted around the pipe 12 is pushed by the pipe retaining portion 18 and compressed. Thereby, a biasing force that biases in the direction to cause the slider 9 to retract is generated. Here, particularly when the one end portion 11*a* of the cam follower 11 passes from the point A through the point B to the point C, the one end portion 11*a* as shown in FIG. 8A does not proceed any further, and the operator senses this by the tip of the finger. Therefore, when the operator stops pressing the card 2, the slider 9 is made to retract by the biasing force of the coil spring 13 and thereby the one end portion 11*a* of the cam follower 11 moves from the point C to the point D as shown in FIG. 7. Then, since the one end portion 11*a* of the cam follower 11 at this point D cannot proceed any further in the biasing direction of the coil spring 13 as shown in FIG. 8B, it stops here. Accordingly, the card 2 also retracts accompanying this and is held in the second position, and so the electrodes (terminals) are conducted by being connected to the input/output terminals on the side of the housing 3.

Moreover, by pushing the card 2 in this way and making the one end portion 11*a* of the cam follower 11 relatively move in the cam groove 15 of the slider 9, when the one end portion 11*a* reaches the point C as shown in FIG. 7 from the point B, that is, when the slider 9 moves from the first position to the second position, the middle portion of the cam follower 11 described above abuts the first projected wall 18*a* and surmounts it. At this time, the operator of the card 2 perceives as a click sensation the surmounting of the cam follower 11 over the first projected wall 18*a*. Thereby, it is confirmed that the card 2 together with the slider 9 has moved to the second position, that is, the electrodes (terminals) of the card 2 are conducted by being connected to the input/output terminals of the housing 3 side.

Then, when use of the card 2 is completed, the card 2 is pressed again to eject it from the card connector 1. Upon doing so, as a result of the movement of the slider 9, the one end portion 11*a* of the cam follower 11 moves relatively in the cam groove 15 of the slider 9 and moves from the point D to the point E as shown in FIG. 7. Upon reaching the point E, as shown in FIG. 8C, the one end portion 11*a* does not proceed any further, and the operator senses this by the tip of the finger. Therefore, when the operator stops pressing the card 2, the slider 9 is made to retract by the biasing force of the coil spring 13 and thereby the one end portion 11*a* of the cam follower 11 moves from the point E through the point B to return to the point A which is the initial position, and stops here as shown in FIG. 7. Therefore, the card 2 is returned to the first position together with the slider 9, and thus enters the state shown in FIG. 1.

Moreover, by pushing the card 2 in this way and making the one end portion 11*a* of the cam follower 11 relatively move in the cam groove 15 of the slider 9, when the one end portion 11*a* moves from the point D to the point E and furthermore reaches the point A, that is, when the slider 9 moves from the second position to the first position, the middle portion of the cam follower 11 described above abuts the second projected wall 18*b* and surmounts it. At this time, the operator of the card 2 perceives as a click sensation the surmounting of the cam follower 11 over the second projected wall 18*b*. Thereby, it is confirmed that the card 2 has separated from the second position.

Thus, even when the card 2 has returned to the first position, by being in this state, the card 2 as described above enters a state of being locked (half locked) in the card connector 1, and for that reason does not automatically come out therefrom. Therefore, the card 2 is removed from the card connector 1 by the operator extracting it. By thus extracting the card 2 that is in the first position, the engagement recess portion 2*a* of the card 2 pushes the engagement portion 14*f* of the lock portion 14, whereby the lock portion 14 bends to the side of the pipe retaining portion 19 by being biased in the horizontal direction (the direction of the inner surface 22), and the lock of the card 2 by the engagement portion 14*f* is released. Thereby, the card 2 is extracted from the card connector 1.

Note that in the state of the card 2 being in the second position, in the event of an extraction force that is comparatively small being accidentally imparted to the card 2 by dropping or the like, the card 2 is prevented from being pulled out by the lock force of the lock portion 14. That is, even when a pulling-out force is applied to the card 2 in the state shown in FIG. 8B, since the movement is restricted by the lock portion 14 in this state, the locking of the card 2 by the engagement portion 14*f* is not released, and accordingly the locked state is maintained.

Also, even in the state of the card 2 being in the second position, in the event of a large pulling-out force being imparted to the card 2, due to the lock portion 14 bending to the side of the inner surface 22, the engagement portion 14*f* separates from the engagement recess portion 2*a*. Accordingly, the lock of the card 2 is released, allowing it to be drawn out from the card connector 1.

Thus, the card connector 1 of the present constitution is provided with a double half lock mechanism that, when removing the card 2, requires a comparatively small force in the first position and requires a comparatively large force in the second position. Accordingly, due to the eject mechanism (heart cam mechanism), when the card 2 is ejected, it is possible to prevent the card 2 from flying out with a strong force, and when the card 2 in the second position due to, for example, a wrong operation, is forcibly pulled out, the card 2 can be pulled out without damaging the card connector 1.

Also, by separately providing the first projected wall 18*a* and the second projected wall 18*b* and having the cam follower 11 surmount them, a click sensation is transmitted to the operator. Therefore, it is possible to perceive when the slider 9 moves from the first position to the second position, or returns from the second position to the first position. Accordingly, there is no need to provide a step for producing a click sensation in a cam groove as is done conventionally. Thereby, polishing of the one end portion 11*a* of the cam follower 11 can be simplified, and thus a cost reduction can be achieved.

Also, in the slider unit 4 that is used in this card connector 1, since the pipe 12 is inserted in the coil spring 13 to retain the coil spring 13, a conventional cylindrical portion is not required. Moreover, since the pipe 12 provided in place of a conventional cylindrical portion is inserted in the coil spring 13, the space especially for this pipe is not required. Accordingly, it is possible to eliminate the portion of space that was required for the conventional cylindrical portion. Therefore, it is possible to miniaturize the card connector 1 that uses this slider unit 4.

Also, the die that forms the slider unit 4 is one that is comparatively simplified due to the absence of the cylindrical portion. Accordingly, configuring the die for multi-cavity molding becomes easy, and so the slider unit 4 can be produced with a lower cost in terms of both initial cost and running cost.

In addition, by forming the enlarged diameter portions 12*a* and 12*b* at both end portions of the pipe 12, the coil spring 13 that is once fitted and held between the enlarged diameter portions 12*a* and 12*b* does not fall out, is easy to handle by being integrated with the slider 9, and is readily mounted on the housing 3, and thus has extremely favorable workability. Accordingly, assembly is facilitated during assembly, so that an improvement in productivity is achieved.

Also, once incorporated into the housing 3, since the coil spring 13 does not come into direct contact with the side wall of the housing 3, it is possible to prevent slight distortions of the housing 3 that occur due to the biasing force of the coil spring 13 being applied to the housing 3. Moreover, even when the heat of the terminal members which have been elevated to a high temperature during reflow soldering is transmitted to the housing 3, since the coil spring 13 does not come into direct contact with the housing 3, it is possible to prevent distortion of the housing 3 due to the biasing force of the coil spring 13.

Note that the lock portion 14 may be eliminated, and the card 2 retaining function may be implemented in the input/output terminals that are formed in the bottom surface of the housing 3. That is, the card 2 may be retained by using the resiliency of the input terminal by pressing the card 2 to the cover side of the housing 3 not illustrated. Accordingly, prevention of the card 2 to be pulled out is possible by the pressing force of the input terminal.

Also, the slider unit 4 may be used as a member that guides various plate-shaped storage mediums such as the card 2 or the like in a device other than the card connector 1 described above.

The present embodiments are not to be considered as being limited by the foregoing description, with various design modifications possible without departing from the spirit or scope of the present invention.

Figure 9:
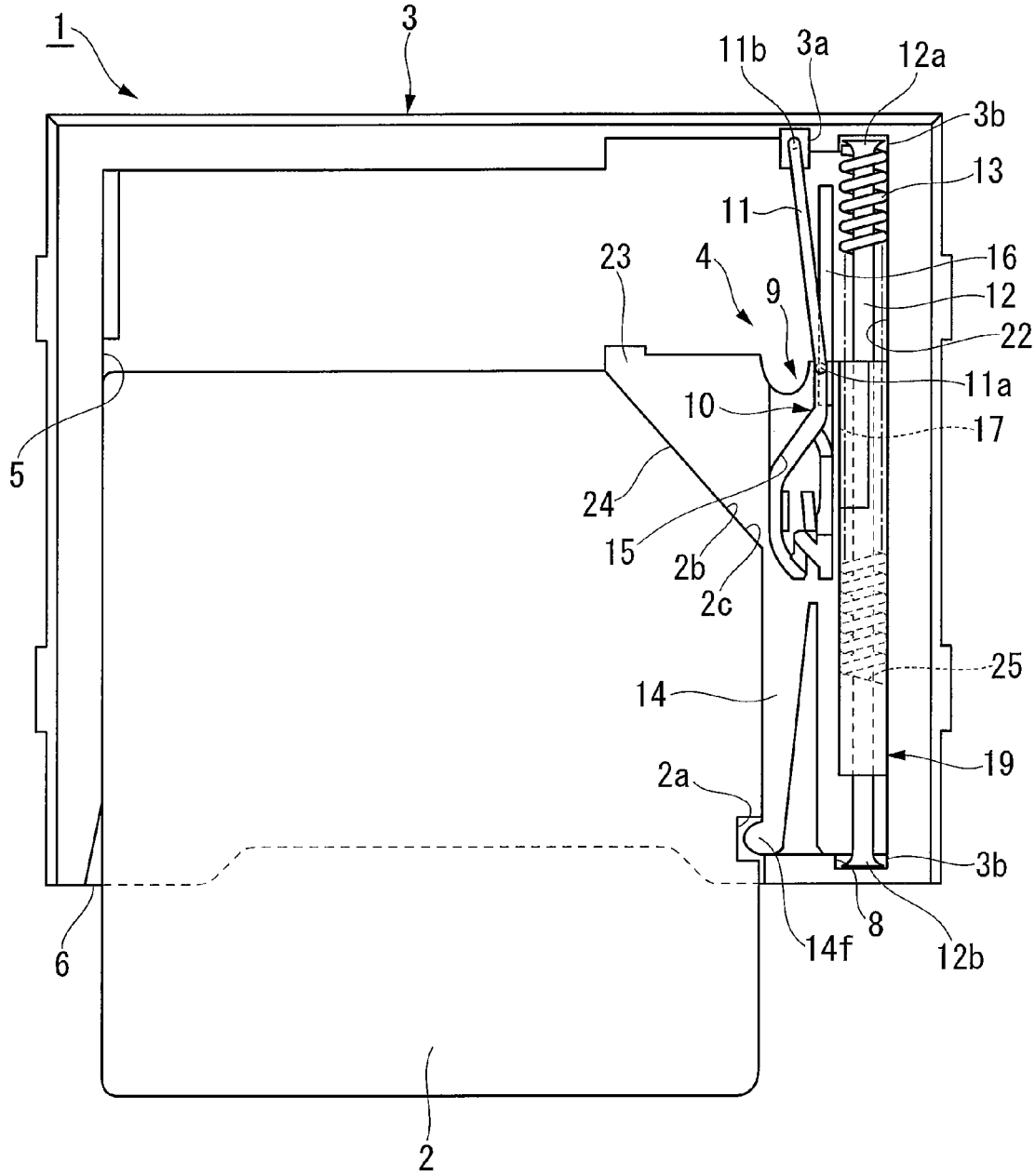
FIG. 9 A plan view that shows another embodiment of the card connector of the present invention.

For example, a flat spring 25 with a V shaped cross-section having a stronger spring action than the coil spring 13 may be mounted in addition to the coil spring 13 to the pipe 12 as shown in FIG. 9. This plate spring 25 is a metal plate bent in a V shape, being formed so that when bent from this V-shaped state in a direction in which bending pieces 25*a* and 25*a* approach each other, exerts a biasing force to open to the original state. Mounting holes (not illustrated) are formed in the bending pieces 25*a* and 25*a* for letting the pipe 12 pass through. Also, this flat spring 25 is disposed in the pipe 12 between the coil spring 13 and the pipe retaining portion 19, and so since the pipe 12 is passed through the mounting holes in this position, the flat spring 25 is attached to the pipe 12.

Here, when the flat spring 25 is closed in the opposite direction to the biasing direction by the bending pieces 25*a* and 25*a* being bent in directions to approach each other, the inner edge of the mounting holes do not make strong contact with the pipe 12, and so the restraining force due to friction on the pipe 12 becomes small. On the other hand, when opened in the biasing direction, the inner edges of the mounting holes make strong contact with the pipe 12, and so the restraining force due to the friction thereby becomes great.

In the card connector 1 consisting of this constitution, the card 2 is returned to the first position from the second position by the heart cam mechanism 10, and when attempting to remove the card 2, the card 2 is returned to the first position via the slider 9 by the biasing force between the coil spring 13 and the flat spring 25 that are fitted on the pipe 12. At this time, first the flat spring 25, which has a stronger spring action than the coil spring 13, exerts its biasing force and so changes from its closed state to its open state. Then, because the restraining force due to friction of the flat spring 25 on the pipe 12 becomes great, the coil spring 13 extends from its compressed state to revert to its original state. At this time, the restraining force of the flat spring 25 acts on the pipe 12, and the impetus when the card 2 returns from the second position to the first position is restricted.

Accordingly, it is possible to prevent problems such as the card 2 falling and breaking as a result of flying out of the card connector 1 with a strong impetus.

Figure 10:
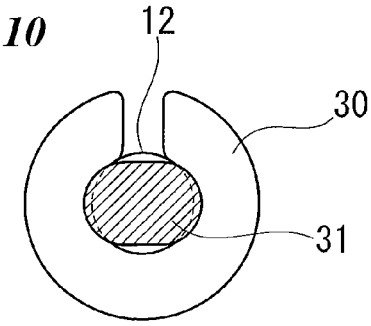
FIG. 10 A main portion sectional view showing the state of the C-ring fitted on the enlarged diameter portion of the pipe.

Also, for example, a C-ring 30 as shown in FIG. 10 may be provided at the attachment position of the flat spring 25 to form an enlarged diameter portion 31 in which, by crushing a portion of the pipe 12, the wire diameter of the pipe 12 is partially enlarged compared to the middle portion. With such a constitution, the card 2 returns from the second position to the first position by the abovementioned heart cam mechanism 10, and when attempting to remove the card 2, due to the biasing force of the coil spring 13 that is fitted on the pipe 12, the card 2 is returned to the first position via the slider 9. At this time, the C-ring 30 that is fitted on the pipe 12 engages with the enlarged diameter portion 31 of the pipe 12, and a restraining force due to the friction on the pipe 12 is generated. Accordingly, when the coil spring 13 extends from its compressed state to revert to its original state, the restraining force acts on the pipe 12 due to the C-ring 30. Thereby, the impetus when the card 2 returns from the second position to the first position is restricted.

Accordingly, with this constitution as well, it is possible to prevent problems such as the card 2 falling and breaking as a result of flying out of the card connector 1 with a strong impetus.

In addition, instead of using this C-ring 30, a portion of the end portion of the coil spring 13, that is, a portion on the side of the flat spring 25 in FIG. 9, for example two windings, may be made to have a smaller spring diameter. Thereby, when the portion with the reduced spring diameter engages with the enlarged diameter portion 12*a*, a restraining force due to the friction on the pipe 12 is generated. Accordingly, when the coil spring 13 extends from its compressed state to revert to its original state, a restraining force can be made to act on the pipe 12 due to this portion with the reduced spring diameter.

With regard to the present slider unit and card connector, since a coil spring is retained by passing a shaft through the coil spring, a conventional cylindrical portion is not required, thus enabling the miniaturization of devices that use the slider unit. Also, since the cylindrical portion is not required, the die that forms the slider unit is comparatively simplified, and it is possible to use a die that allows multi-cavity molding, thereby enabling a reduction in the initial cost and running cost. Furthermore, by forming the enlarged diameter portions on both ends of the shaft, once the coil spring has been fitted on the shaft it does not fall off the shaft, and so its handling is simplified. Moreover, since the coil spring does not come into direct contact with the side wall of the housing, the biasing force of the coil spring is not applied to the housing. Therefore, when incorporated in the housing, simultaneous with being able to prevent distortions of the housing, it is possible to prevent distortions of the housing when the slider unit is mounted by reflow soldiering. Also, since one of the ends of the shaft is held by the slider, the coil spring is integrated with the slider along with the shaft. Thereby, since it is only needed to be held in the retaining portion of the housing during assembly, assembly is facilitated, and productivity is improved.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A slider unit provided in a housing, the housing defining a card housing space having an opening and configured to allow the insertion of a card from the opening, the slider unit configured to perform housing of the card into the card housing space and ejection of the card from the card housing space, the slider unit comprising:

a slider that is arranged in the housing so as to be capable of moving along insertion/ejection directions of the card and whose position is capable of being switched by a heart cam mechanism between a first position and a second position that is farther from the opening than the first position;

a coil spring that biases the slider in the card ejection direction;

an abutting portion that is integrally formed in the slider and is capable of abutting an insertion direction side of the card; and a shaft that is provided in the slider and retains the coil spring by being inserted in the coil spring;

wherein both ends of the shaft that protrude from the coil spring become enlarged diameter portions that are partially widened compared to the middle portion on which the coil spring is fitted.

2. The slider unit in accordance with claim 1, wherein one end of the shaft is held by the slider.

3. A card connector comprising:

a housing that forms a card housing space that allows the insertion of a card from an opening and is provided with an input/output terminal that corresponds to an electrode portion of the card;

a slider that is capable of moving along insertion/ejection directions of the card and whose position is capable of being switched by a heart cam mechanism between a first position and a second position that is farther from the opening than the first position;

a coil spring that biases the slider in the card ejection direction; and an abutting portion that is integrally formed in the slider and is capable of abutting the insertion direction side of the card;

wherein the coil spring is fitted on a middle portion of a shaft that has at both ends enlarged diameter portions that are partially widened compared to the middle portion and the enlarged diameter portions are retained by the retaining portion that is formed in the housing.

4. The card connector in accordance with claim 3, wherein one end of the shaft is held by the slider.

* * * * *